United States Patent [19]

Hain

[11] Patent Number: 4,989,520

[45] Date of Patent: Feb. 5, 1991

[54] CONTAINER FOR HOLDING A STACK OF ARTICLES

[75] Inventor: David A. Hain, Monifieth, Scotland

[73] Assignee: NCR Corporation, Dayton, Ohio

[21] Appl. No.: 433,497

[22] Filed: Nov. 8, 1989

[30] Foreign Application Priority Data

Jun. 30, 1989 [GB] United Kingdom ..... 8915048

[51] Int. Cl.[5] ..... G07G 5/00

[52] U.S. Cl. ..... 109/24.1; 109/66

[58] Field of Search ..... 109/24.1, 55, 66; 271/180

[56] References Cited

U.S. PATENT DOCUMENTS

| | | | |
|---|---|---|---|
| 3,836,980 | 9/1974 | Grosswiller et al. | 109/66 X |
| 4,308,804 | 1/1982 | Guibord et al. | 109/124.1 |
| 4,512,263 | 4/1985 | Lanning | 109/24.1 X |
| 4,628,192 | 12/1986 | Suzuki | 109/24.1 X |
| 4,696,426 | 9/1987 | Decker et al. | 109/24.1 X |
| 4,726,474 | 2/1988 | Arikawa et al. | 109/24.1 X |
| 4,747,354 | 5/1988 | Fee et al. | 109/24.1 |

FOREIGN PATENT DOCUMENTS

| | | |
|---|---|---|
| 0166253 | 5/1985 | European Pat. Off. . |
| 86/05301 | 2/1986 | PCT Int'l Appl. . |
| 2091225A | 12/1981 | United Kingdom . |

OTHER PUBLICATIONS

U.S. patent application Ser. No. 443,093, filed Nov. 8, 1989, (NCR Docket 4246).

*Primary Examiner*—Gary L. Smith
*Assistant Examiner*—Suzanne L. Dino
*Attorney, Agent, or Firm*—Wilbert Hawk, Jr.; Albert L. Sessler, Jr.

[57] ABSTRACT

A container (24) for holding a stack of envelopes (122) includes pusher means (146) for pushing envelopes from a receiving zone (A) into a storage zone (B) past resiliently mounted flaps (132). The stack is supported on a support member (130) which is slidably and resiliently mounted in the container (24). A shaft (184) to which gear means (186, 188) are secured is rotatably mounted on the support member (130), the gear means (186,188) engaging with fixed rack means (180). A ratchet wheel (194) engageable by a pawl (200) is freely mounted on the shaft (184) which passes through a torsion spring the ends of which are respectively attached to the shaft (184) and the ratchet wheel (194). When the support member (130) is moved away from the flaps (132) torsion is built up in the spring since rotation of the ratchet wheel (194) is prevented, this torsion serving to urge the support member (130) back towards the flaps (132). The support member (130) is removable from the container (24) together with the stack.

11 Claims, 7 Drawing Sheets

CONTAINER FOR HOLDING A STACK OF ARTICLES

CROSS-REFERENCE TO RELATED APPLICATION

Apparatus for Stacking Articles in a Container, U.S. Ser. No. 433,093 filed Nov. 8, 1989 inventor David A. Hain.

BACKGROUND OF THE INVENTION

This invention relates to a container for holding a stack of articles.

The invention has application, for example, to a depository apparatus included in an automated teller machine (ATM) of the kind which is arranged to dispense currency notes, or accept a deposit of money, as may be required by a customer. As is well known, in operation of an ATM of this kind, a user inserts a customer identifying card into the machine and then enters certain data (such as a personal identification number, type of transaction, and quantity of money required or to be paid in) on one or more keyboards included in a user console of the machine. The machine will then process the transaction, dispense currency notes or accept a money deposit as may be requested, and return the card to the user as part of a routine operation. If money is to be deposited, the user typically inserts an envelope containing the money (cash and/or checks) through a deposit entry slot in the user console, and the depository apparatus of the ATM transports the envelope to, and deposits it in, a portable container included in the apparatus.

In some known types of depository apparatus, envelopes are simply dropped one by one by a transport mechanism into a portable container. Such an apparatus has the disadvantage that envelopes are deposited in a non-orderly manner in the container, thereby reducing the storage capacity of the container and hindering checking and reconciliation procedures when the envelopes are removed from the container.

A depository apparatus in which envelopes are stacked in an orderly sequential manner in a container is know from U.S. Pat. No. 4,512,263. In operation of this known apparatus, each envelope to be stacked is fed under gravity into a receiving zone which is separated from a storage zone by gate means arranged to permit one-way passage of the envelope from the receiving zone into the storage zone. When in the receiving zone, each envelope is supported by one of its edges in a vertical position, and pusher means are provided for pushing the envelope past the gate means into the storage zone against the pressure of a vertical stacker plate which is positioned in the storage zone and which is resiliently biased towards the gate means. The stacker plate forms part of a stacker plate assembly incorporating a tension spring which passes around a pulley positioned adjacent the gate means and the ends of which are respectively attached to the stacker plate and to a stud secured to a part of the container remote from the gate means. No means is described as to how a stack of envelopes may be removed from the container, but in any case the incorporation in the container of the stacker plate assembly described above would present problems regarding such removal.

SUMMARY OF THE INVENTION

According to the invention, a container for holding a stack of articles, said container including an aperture for receiving articles one by one to be stacked in said container, a receiving portion for receiving the articles passed through said aperture and a storage portion for storing articles which have been received in said container, comprises: gate means in said container for permitting, during a stacking operation, one-way passage of an article from said receiving portion of said container into said storage portion of said container; pusher means movable between first and second positions and arranged when moved from said first position to said second position to push an article in said receiving portion past said gate means and into said storage portion; and resilient support means mounted in said storage portion and arranged to support a stack of articles, said support means including a support member slidably mounted in said storage portion so as to be movable towards and away from said gate means, a shaft rotatably mounted on said support member, first and second gear means respectively secured to opposite end portions of said shaft, first and second rack members fixed relative to said storage portion and respectively engageable with said first and second gear means whereby movement of said support member towards or away from said gate means brings about rotation of said shaft in a direction determined by the direction of movement of said support member, a torsion spring mounted on said shaft with said shaft passing through said spring so as to be substantially coaxial therewith having one end of said spring secured to said shaft, retaining means rotatably mounted on said shaft and having said other end of said spring secured to said retaining means, and engagement means mounted on said support member and arranged to be engageable with said retaining means whereby, when said engagement means is in engagement with said retaining means and said support member is moved away from said gate means in response to movement of said pusher means towards said second position, rotation of said retaining means in the same direction as said shaft is prevented, thereby causing torsion to be built up in said spring, said torsion serving to urge said support member back towards said gate means when said pusher means moves back towards said first position.

It is an object of the invention to provide a container for holding a stack of articles, which container is of simple construction and facilitates the removal of the stack from the container.

One embodiment of the invention will now be described by way of example with reference to the accompanying drawings.

DESCRIPTION OF THE PREFERRED EMBODIMENT

Figure 1:
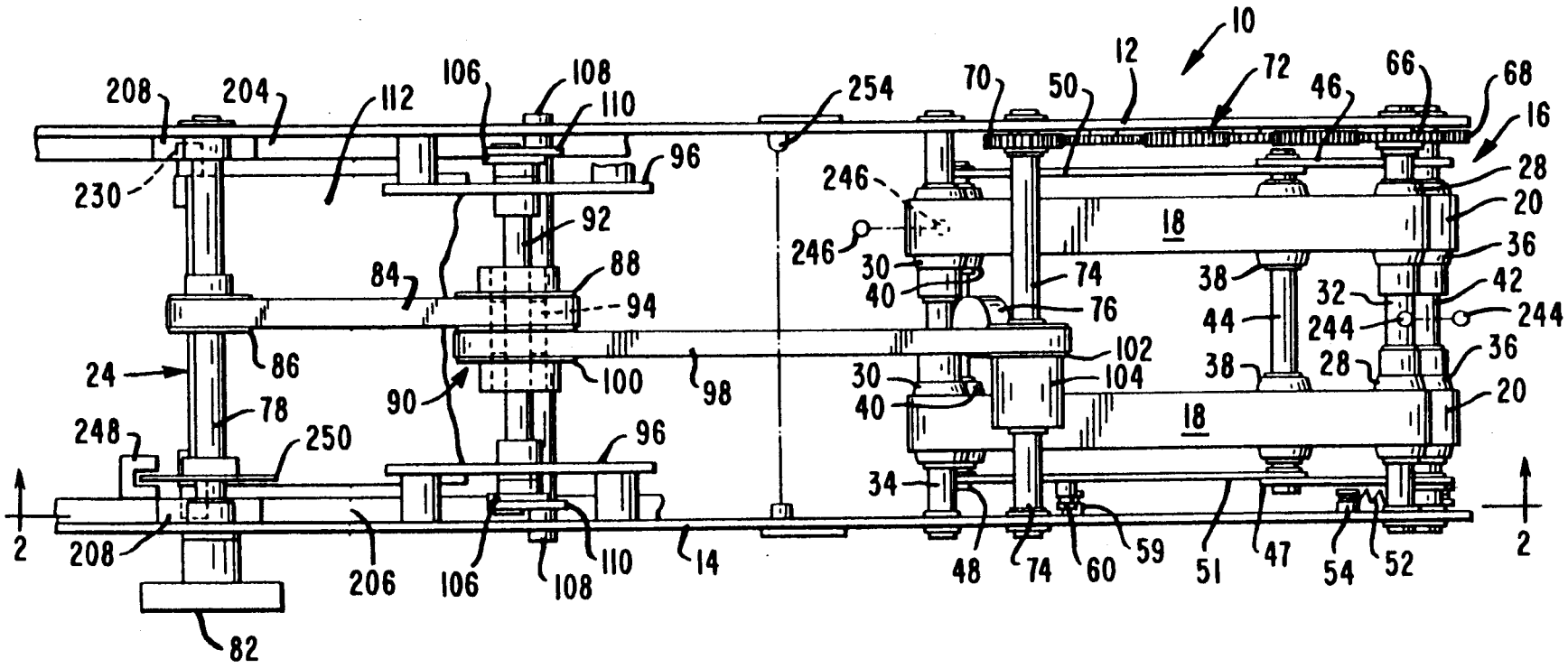
FIG. 1 is a plan view of a depository apparatus in accordance with the invention.
Figure 2:
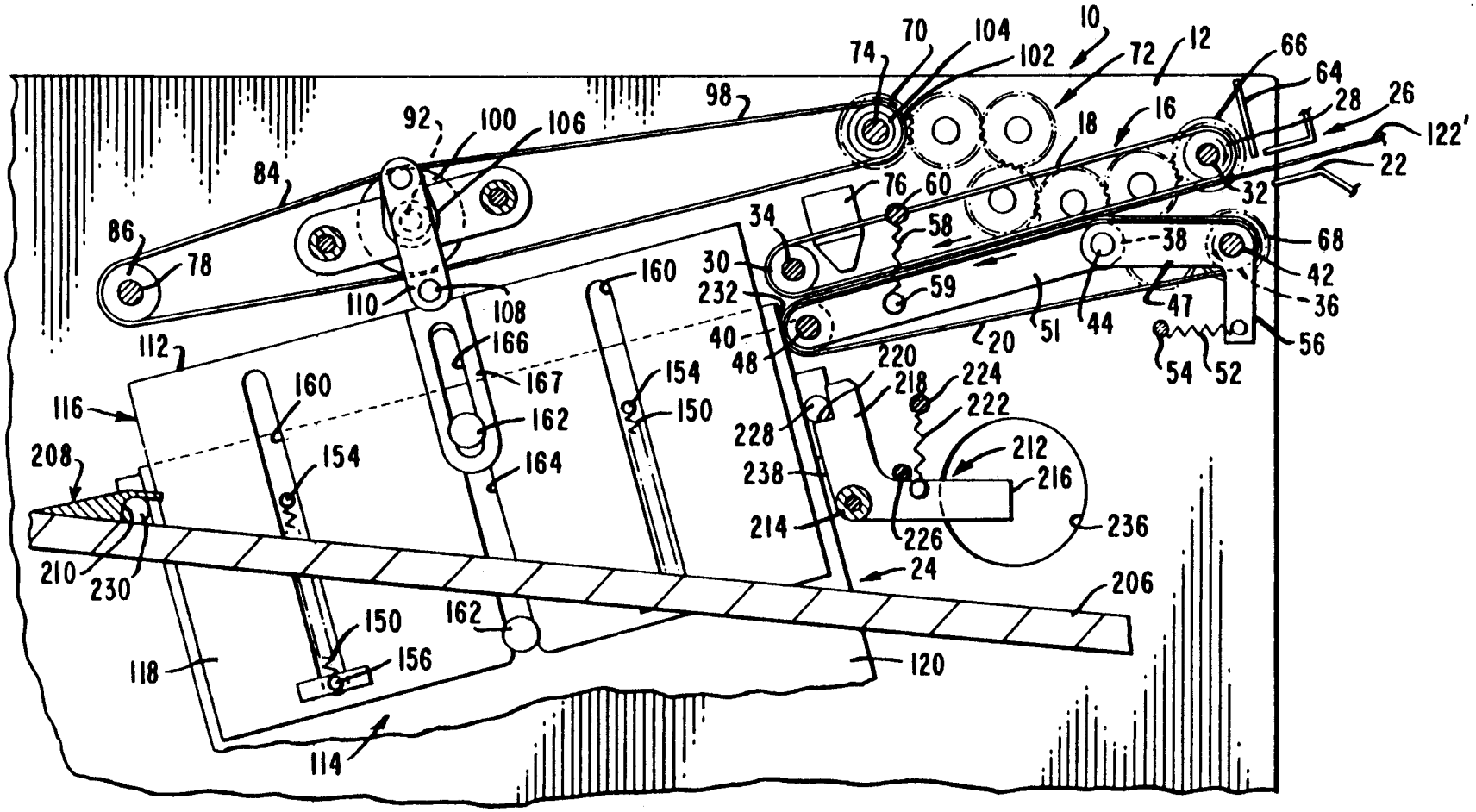
FIG. 2 is a sectional, side elevational view of the depository apparatus, the section being taken along the line 2—2 of FIG. 1.

Referring to FIGS. 1 and 2, the depository apparatus shown therein includes a supporting framework 10 having side walls 12 and 14. The depository apparatus includes a transport mechanism 16 having an upper pair of endless belts 18 and a lower pair of endless belts 20 which respectively cooperate with the belts 18. The cooperating belts 18 and 20 serve to feed envelopes, such as the envelope 122' shown in FIG. 2, from an entry slot 22 to a depository container 24 (shown partly broken away in each of FIGS. 1 and 2), the entry slot 22 being located in a user console 26 (not shown in FIG. 1) of an ATM in which the depository apparatus is included. As will be explained later, the depository container 24 is readily removed from, or insertable in, the framework 10.

Each of the belts 18 passes around respective pulleys 28 and 30. The pulleys 28 are secured on a shaft 32 and the pulleys 30 are secured on a shaft 34, the shafts 32 and 34 extending between, and being rotatably mounted with respect to, the side walls 12 and 14. Each of the belts 20 passes around respective pulleys 36, 38 and 40. The pulleys 36 are secured on a shaft 42 which extends between, and is rotatably mounted with respect to, the side walls 12 and 14; the pulleys 38 are rotatably mounted on a shaft 44 extending between corresponding ends of a first pair of support arms 46 and 47 which are respectively positioned adjacent the side walls 12 and 14; and the pulleys 40 are rotatably mounted on a shaft 48 extending between corresponding ends of a second pair of support arms 50 and 51 which are also respectively positioned adjacent the side walls 12 and 14. The ends of the support arms 46 and 47 remote from the shaft 44 are pivotably mounted on the shaft 42, and the ends of the support arms 50 and 51 remote from the shaft 48 are pivotably mounted on the shaft 44. The assembly of the support arms 46, 47 and shaft 44 is biased in a clockwise direction (with reference to FIG. 2) about the axis of the shaft 42 by means of a spring 52 connected between a stud 54 secured to the side wall 14 and a projection 56 projecting from the arm 47. (It should be understood that, hereinafter, any reference to clockwise direction or counterclockwise direction in relation to items shown in FIGS. 1 or 2 will be with reference to FIG. 2). The assembly of the support arms 50 and 51 and shaft 48 is biased in a clockwise direction about the axis of the shaft 44 by means of a spring 58 connected between a stud 59 on the arm 51 and a further stud 60 secured to the side wall 14. Those portions of the upper parts of the belts 20 extending between the pulleys 40 and 38 are respectively positioned in cooperative relationship with corresponding portions of the belts 18, while those portions of the upper parts of the belts 20 extending between the pulleys 38 and 36 are directed away from the belts 18 so as to form an entry throat adjacent the entry slot 22.

It should be understood that normally the entry slot 22 is closed by a shutter 64 (not shown in FIG. 1). When a user of the ATM has indicated that he wishes to deposit a envelope containing money in the ATM, the shutter 64 is retracted in an upwards direction by an actuating solenoid 65 (FIG. 7) to the position shown in FIG. 2 so as to enable the user to envelope 122' through the entry slot 22 and insert the envelope 122' through the entry slot 22 and into the entry throat with a short edge of the envelope leading, whereupon the leading edge of the envelope 122' is gripped by the cooperating portions of the belts 18 and 20.

The shafts 32 and 42 are respectively driven by gears 66 and 68 in the directions indicated by the associated arrows in FIG. 2. The gears 66 and 68 are in turn driven by a gear 70 via a gear train 72, the gear 70 being mounted on a shaft 74 which extends between, and is rotatably mounted with respect to, the side walls 12 and 14. When the shafts 32 and 42 are driven by the gears 66 and 68, the belts 18 and 20 convey the envelope 122' from the entry slot 22 into the depository container 24 in a manner to be described in more detail later. By virtue of the fact that the shafts 44 and 48 carrying the pulleys 38 and 40 are mounted on the resiliently supported arms 46, 47 and 50, 51, envelopes having a wide range of thicknesses (up to 1.25 centimeters thick) can be conveyed by the belts 18 and 20 to the container 24.

An ink jet printer 76 is mounted by support means (not shown) between the belts 18, the printer 76 being arranged to print identifying information on each envelope as it is conveyed from the entry slot 22 to the container 24.

A drive shaft 78 extends between, and is rotatably mounted with respect to, the side walls 12 and 14. The drive shaft 78 is positioned adjacent the rear of the framework 10, that is to say the end of the framework 10 remote from the user console 26, and is driven by a bidirectional electric motor 80 (FIG. 7) via transmission means which includes a pulley 82 but which is not otherwise shown. An endless belt 84 passes around a pulley 86 secured on the drive shaft 78 and around a first pulley portion 88 of a composite pulley 90. The pulley 90 is mounted on a shaft 92 by means of a roller clutch 94, the shaft 92 extending between, and being rotatably mounted with respect to, two support brackets 96. The brackets 96 are respectively secured to, and spaced from the inner faces of, the side walls 12 and 14.

When the drive shaft 78 is driven in a clockwise direction by the motor 80, the roller clutch 94 enables the composite pulley 90 to rotate freely on the shaft 92 without any drive being transmitted to the shaft 92. When the drive shaft 78 is driven in a counterclockwise direction by the motor 80, the roller clutch 94 transmits drive to the shaft 92 so as to cause the shaft 92 to rotate in a counterclockwise direction. A further endless belt 98 passes around a second pulley portion 100 of the composite pulley 90 and around a pulley 102 which is mounted on the shaft 74 by means of a roller clutch 104. When the composite pulley 90 is driven in a clockwise direction by the belt 84, the roller clutch 104 transmits drive to the shaft 74 so as to cause the shaft 74 to rotate in a clockwise direction, but, when the pulley 90 is driven in a counterclockwise direction by the belt 84, the pulley 102 rotates freely on the shaft 74 without any drive being transmitted to the shaft 74. Thus, it will be appreciated that, when the motor 80 drives the drive shaft 78 in a clockwise direction, drive is transmitted to the transport mechanism 16, with no drive being transmitted to the shaft 92, and that, when the motor 80 drives the drive shaft 78 in a counterclockwise direction, no drive is transmitted to the transport mechanism 16, but drive is transmitted to the shaft 92 so as to cause it to rotate in a counterclockwise direction.

Two crank arms 106 are respectively secured to the ends of the shaft 92, each crank arm 106 being located in the space between the relevant side wall 12 or 14 and the adjacent bracket 96. A rod 108 passes through, and is supported by, corresponding ends of two link members 110, the other ends of the link members 110 being respectively pivotably connected to the free ends of the crank arms 106. The ends of the rod 108 respectively slidably engage in two slots (not shown) which are respectively formed in the side walls 12 and 14 and which extend in a direction perpendicular to the top surface 112 of the depository container 24. Thus, rotation of the shaft 92 brings about a reciprocable movement of the rod 108 in this last-mentioned direction via the crank arms 106 and link members 110. In the following description relating to the depository container 24 this last-mentioned direction will be considered to be a vertical direction.

Referring now also to FIGS. 3 to 6, the depository container 24 comprises an envelope storage bin 114 open at the top, and a pusher portion 116 which fits over the top of the bin 114, the pusher portion 116 having downwardly projecting side walls 118 which are respectively in sliding engagement with the outer faces of side walls 120 of the bin 114. The storage bin 114 is adapted to hold a stack of envelopes 122, with the long edges of each envelope respectively adjacent the side walls 120, and with the short edges of each envelope respectively adjacent the front wall 124 and the rear wall 126 of the bin 114. The lower end of the stack of envelopes 122 is supported on an upper planar surface 128 of a support member 130 which is resiliently mounted in the bin 114 in a manner to be described later.

Figure 3:
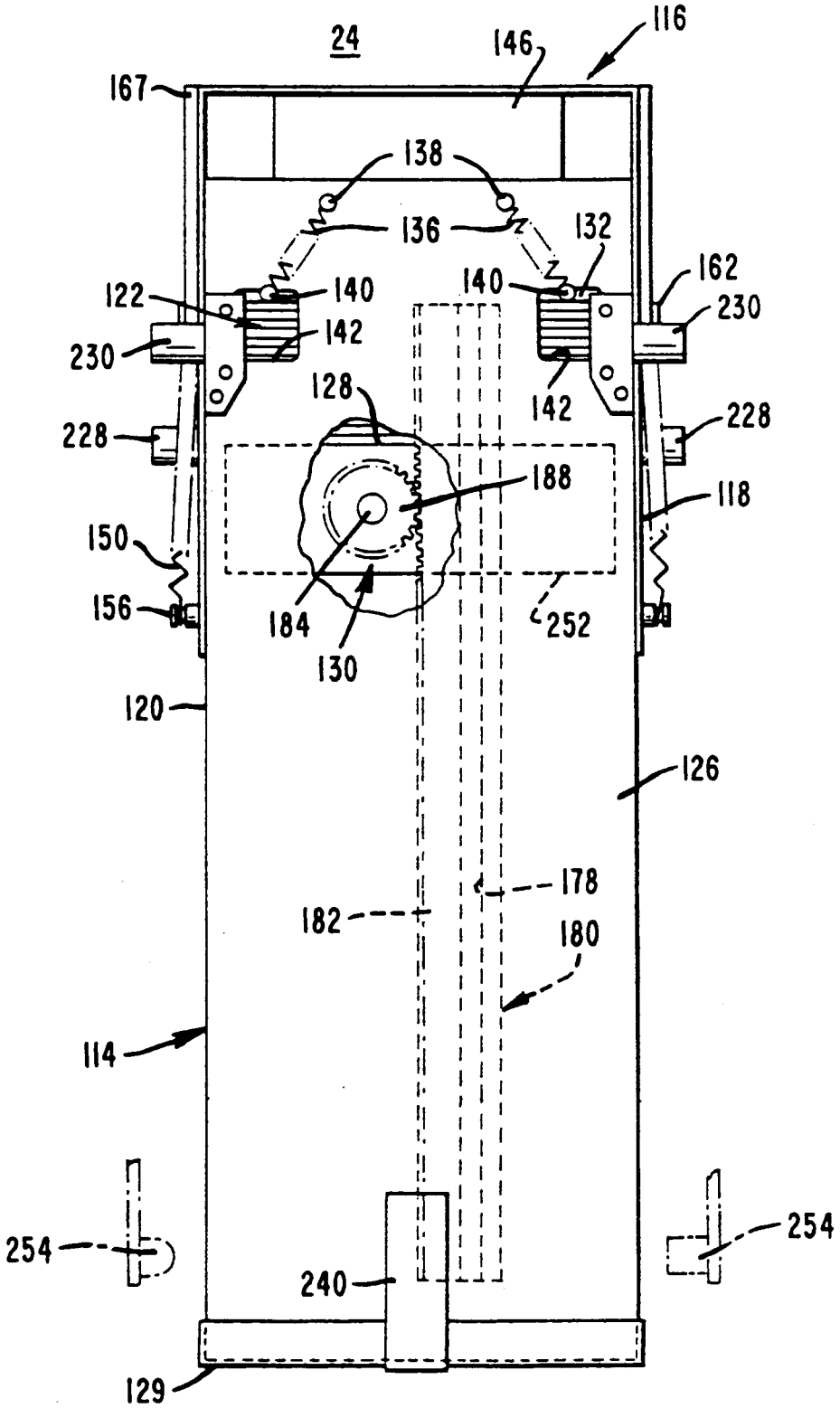
FIG. 3 is a rear elevational view of a depository container included in the apparatus of FIGS. 1 and 2.
Figure 4:
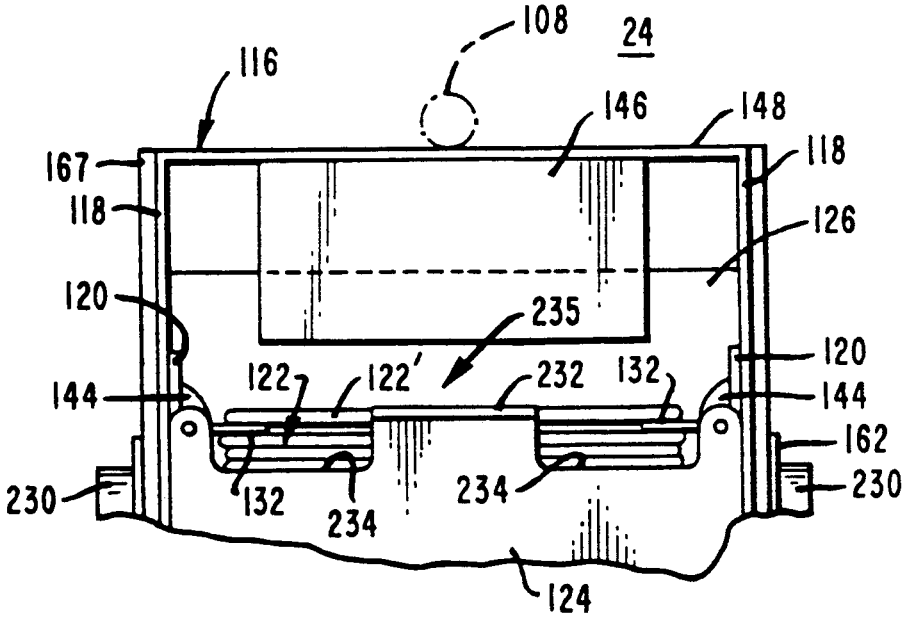
FIG. 4 is an enlarged front elevational view of the top portion of the depository container at the beginning of an envelope pushing operation in which an envelope is pushed into a storage bin of the depository container.

Normally, as shown in FIG. 4, the uppermost envelope in the stack 122 is in engagement with the undersides of two flaps 132 which are respectively pivotably mounted on, and extend along the horizontal dimensions of, the inner faces of the side walls 120. The flaps 132 are normally held in horizontal positions, as shown in FIGS. 3 and 4, by means of two springs 136 (FIG. 3). The springs 136 are connected between studs 138 secured to the outer surface of the rear wall 126 and projections 140 respectively formed on the flaps 132, the projections 140 passing through two apertures 142 formed in the wall 126. Upward pivotal movement of the flaps 132 away from their horizontal positions is prevented by two lugs 144 which are respectively secured to the flaps 132 and which are arranged to engage with the inner faces of the side walls 120 of the bin 114 when the flaps 132 are in their horizontal positions. As will be described in more detail later, the flaps 132 can be pivoted downwardly away from their normal horizontal positions against the action of the springs 136 and pressure exerted by the support member 130 so as to permit an envelope to pass from a receiving zone A (FIG. 5) of the depository container 24 above the flaps 132 into a storage zone B (FIG. 5) of the container 24 below the flaps 132. As will be clear from the subsequent description, the flaps 132 serve as gate means for permitting one-way passage of envelopes one by one from the receiving zone A into the storage zone B.

A pusher block 146 is secured to the lower face of the upper wall 148 of the pusher portion 116, the block 146 being of rectangular cross section and extending along substantially the whole length of the upper wall 148. It should be understood that the upper surface of the wall 148 constitutes the top surface 112 of the depository container 24 as shown in FIGS. 1 and 2. The width of the block 146 is somewhat greater than the spacing apart of the flaps 132 so that the block 146 is capable of engaging with the flaps 132 for the purpose of pivoting the flaps 132 downwardly. The pusher block 146 is normally held out of engagement with the flaps 132 by means of two pairs of springs 150, each pair of springs 150 being connected between studs 154 secured to a respective one of the side walls 120 of the bin 114 and studs 156 secured to the adjacent side wall 118 of the pusher portion 116. Each of the studs 154 passes through a respective slot 160 (FIG. 2) formed in the relevant side wall 118. Each side wall 120 is provided with a pair of guide studs 162 arranged one above the other, each pair of guide studs 162 slidably engaging in a respective slot 164 (FIG. 2) formed in the relevant side wall 118. The pusher portion 116 can be moved downwardly relative to the bin 114 against the action of the springs 150, with the two pairs of guide studs 162 sliding along the slots 164.

Figure 5:
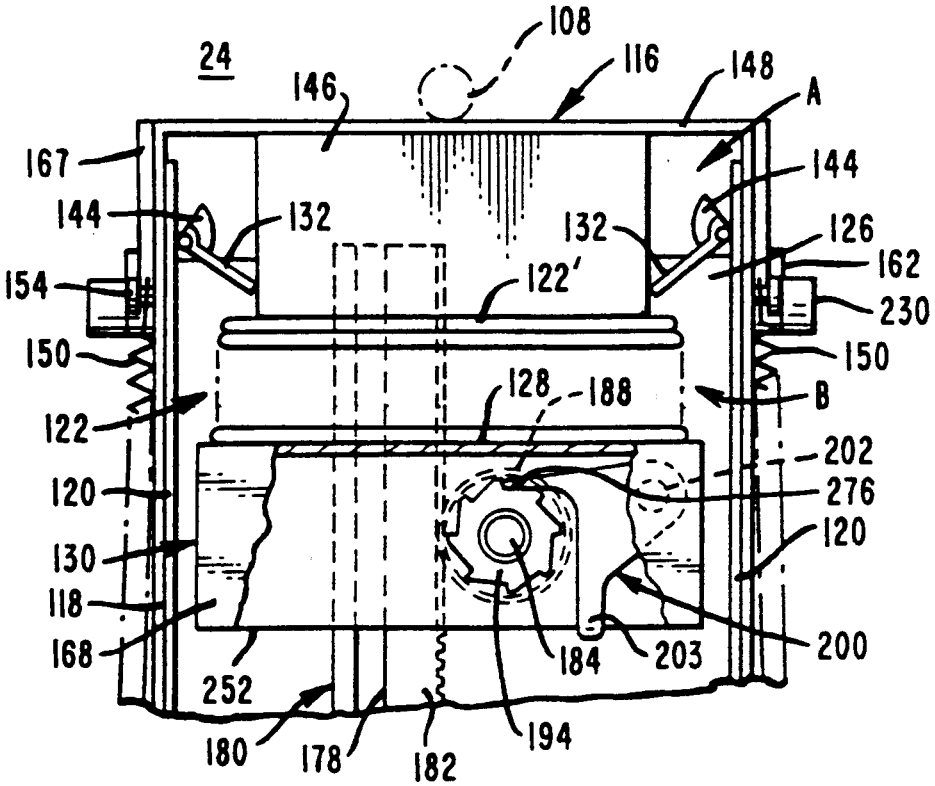
FIG. 5 is a view similar to FIG. 4 but with the front wall omitted and showing the depository container half way through an envelope pushing operation.
Figure 6:
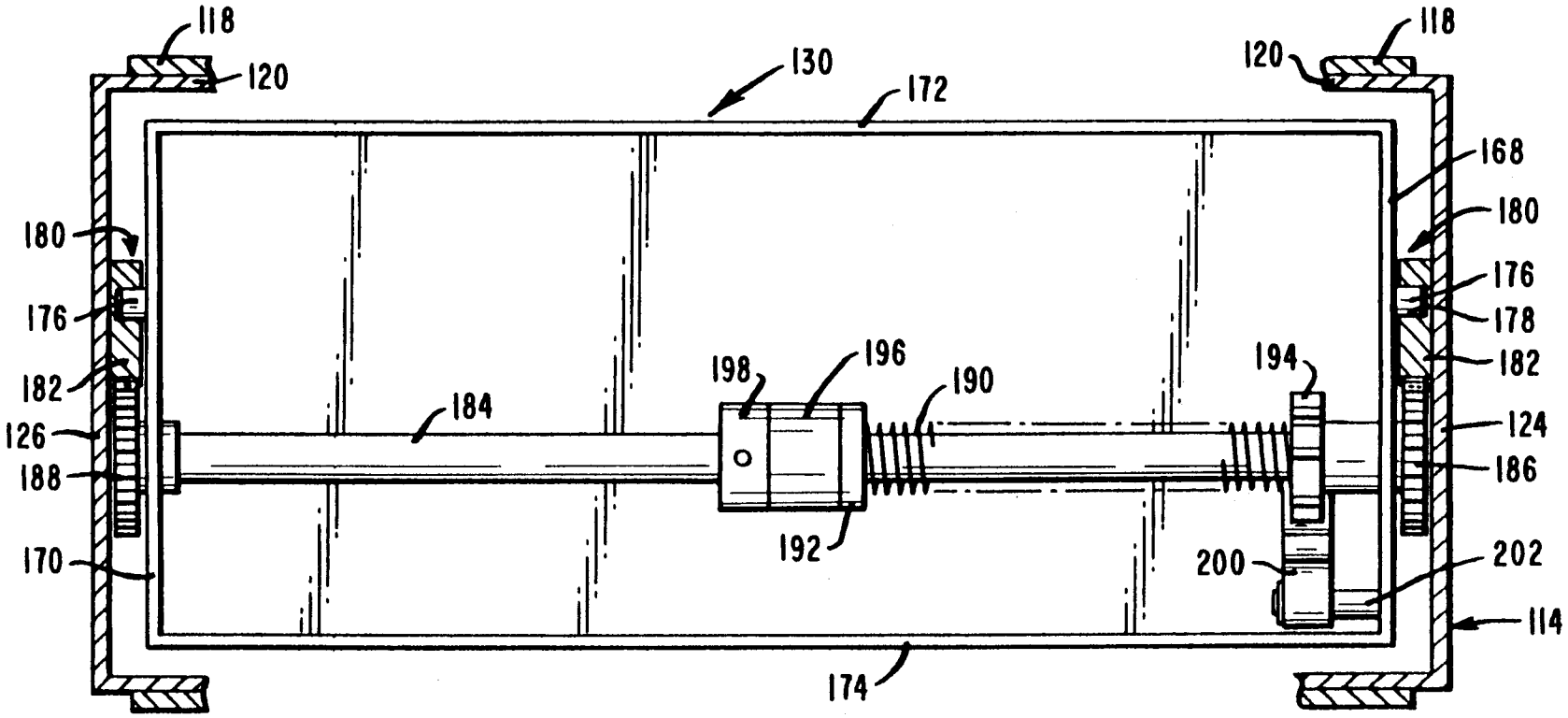
FIG. 6 is a view of support means for a stack of envelopes, the support means being shown mounted in the storage bin with associated parts of the storage bin being shown in section, and with the view of the support means being taken from that side of the support means opposite the envelope engaging surface thereof.

When the depository container 24 is not mounted in the ATM, upward movement of the pusher portion 116 relative to the bin 114 is limited by the engagement of the upper ones of the studs 162 with the closed lower ends of two slots 166 respectively formed in two plates 167 secured to the side walls 118. As shown in FIGS. 2, 4 and 5, when the depository container 24 is mounted in its correct operational position in the ATM, the rod 108 is in engagement with the upper face of the upper wall 148 of the pusher portion 116, the pusher portion 116 being urged resiliently against the rod 108 by the springs 150. Thus, it will be appreciated that, in operation, upward and downward movement of the pusher portion 116 relative to the bin 114 is brought about in response to upward and downward movement of the rod 108.

The support member 130 is of moulded plastics material and has end walls 168 and 170, and side walls 172 and 174. Two rails 176 are respectively provided on the outer surfaces of the end walls 168, 170, the rails 176 respectively engaging in two slots 178 formed in two rack members 180 secured to the inner surfaces of the walls 124, 126 of the bin 114. Each rack member 180 extends along the major part of the length of the relevant wall 124 or 126, and includes a toothed portion 182 extending along its whole length. A shaft 184 extends between, and is rotatably mounted with respect to, the walls 168, 170. Two gear wheels 186 and 188 are respectively secured to end portions of the shaft 184 projecting beyond the walls 168 and 170, the gear wheels 186, 188 respectively engaging with the toothed portions 182. (In FIG. 5 the wall 168 is partly broken away and the adjacent gear wheel 186 is omitted). By virtue of the engagement of the rails 176 in the slots 178, the support member 130 is slidable along the bin 114 either towards or away from the flaps 132, and, by virtue of the engagement of the gear wheels 186, 188 with the toothed portions 182, such sliding movement of the support member 130 brings about a rotation of the shaft 184, the direction of rotation of the shaft 184 being determined by the direction of movement of the support member 130. Thus, with reference to FIG. 5, movement of the support member 130 away from the flaps 132 brings about a rotation of the shaft 184 in a clockwise direction, while a return movement of the support member 130 towards the flaps 132 brings about a rotation of the shaft 184 in counterclockwise direction.

A torsion spring 190 is mounted on the shaft 184 with the shaft 184 passing through the spring 190 so as to be substantially coaxial therewith. One end of the spring 190 is secured to one side of a collar 192 rotatably mounted on the shaft 184, and the other end of the spring 190 is secured to a ratchet wheel 194 rotatably mounted on the shaft 184. The side of the collar 192 remote from the spring 190 is bonded to one side of a damping collar 196 which is freely mounted on the shaft 184 and the other side of which is bonded to a collar 198 secured on the shaft 184. The damping collar 196 is of an elastomeric material such as polyurethane such that it has a slow recovery in respect of a torsional displacement of one side of the collar 196 relative to the other side. A pawl 200 is pivotably mounted on a stud 202 secured to the inner face of the wall 168. When the container 24 is positioned such as shown in FIGS. 3 and 5 with the support member 130 positioned beneath the flaps 132, the pawl 200 is held by gravity in engagement with the ratchet wheel 194 as shown in FIG. 5. The pawl 200 is provided with a downwardly extending projection 203 for a purpose which will be described later. With the pawl 200 in engagement with the ratchet wheel 194, the ratchet wheel 194 and the end of the spring 190 attached thereto are prevented from rotating with the shaft 184 when the support member 130 is moved away from the flaps 132. It will be appreciated, therefore, that movement of the support member 130 away from the flaps 132 causes torsion to be progressively built up in the spring 190, this torsion tending to urge the support member 130 back towards the flaps 132. Thus, the spring 190 causes the stack of envelopes 122 in the bin 114 to be urged upwardly by the upper surface 128 of the support member 130 into engagement with the undersides of the flaps 132.

The inner faces of the side walls 12 and 14 of the framework 10 are respectively provided with two generally horizontally extending guide rails 204 and 206. Two stop members 208, each having a stop surface 210, are respectively secured to the inner faces of the side walls 12 and 14 and are positioned on the rails 204 and 206 adjacent to the rear of the framework 10. Two latch members 212 (not shown in FIG. 1) in the form of bell crank levers are pivotably mounted on two studs 214 respectively secured to the inner faces of the side walls 12 and 14, the latch members 212 being spaced upwardly from the rails 204 and 206 and being positioned a short distance below the pulleys 40. Each latch member 212 comprises a forwardly projecting arm 216 and an upwardly projecting arm 218 provided at its upper end with a rearwardly facing recess 220. Each latch member 212 is biased in a counterclockwise direction by means of a respective spring 222 connected between the arm 216 and a stud 224 secured to the relevant side wall 12 or 14, so as to urge the arm 216 into engagement with a further stud 226 secured to the relevant side wall 12 or 14.

A first pair of support studs 228 are secured to the front wall 124 of the bin 114, and a second pair of support studs 230 are secured to the rear wall 126. The central portion of the upper end of the front wall 124 is formed as a curved guide member 232 with recesses 234 on both sides thereof. The gap between the upper end of the front wall 124 of the storage portion 114 and the upper wall 148 of the pusher portion 116 constitutes an aperture 235 via which envelopes can be fed into the container 24. When the depository container 24 is mounted in its correct operational position in the framework 10, the studs 230 are supported on the rails 204 and 206 and are in engagement with the stop surfaces 210 of the stop members 208, and the studs 228 are located in, and are supported by, the recesses 220 of the latch members 212, the latch members 212 being held by the springs 222 in supporting positions in relation to the studs 228. With the depository container 24 in the operational position just described, the adjacent ends of the endless belts 20 protrude a short distance into the recesses 234, and the guide member 232 is aligned with the upper surfaces of the belts 20 as seen in FIG. 2.

In order to remove the depository container 24 from the depository apparatus, the latch members 212 are pivoted in a clockwise direction against the action of the springs 222 by manual operation of the arms 216 of the latch members 212 through openings 236 respectively formed in the side walls 12 and 14 of the framework 10. This pivotal movement of the latch members 212 disengages the recesses 220 from the studs 228, whereupon the depository container 24 can be pivoted in a clockwise direction about the axis of the studs 230 until the studs 228 engage the rails 204 and 206. Thereafter the depository container 24 can be removed from the depository apparatus through open door means (not shown) at the front of the ATM, the container 24 initially passing under the belts 20 of the transport mechanism 16 with the studs 228 and 230 sliding along the rails 204 and 206.

The manner in which the depository container 24 is inserted in the ATM is substantially a reversal of the manner in which the container 24 is removed. Thus, the depository container 24 is inserted between the side walls 12 and 14 through the afore-mentioned open door means with first the studs 230 and then the studs 228 engaging with the upper surfaces of the rails 204 and 206. The container 24 is slid along the rails 204 and 206 until the studs 230 engage with the stop surfaces 210 of the stop members 208. The container 24 is then pivoted in a counterclockwise direction about the axis of the studs 230 until the studs 228 engage in the recesses 220 in the latch members 212. During this pivotal movement of the container 24, the studs 228 engage with cam surfaces 238 on the latch members 212 so as to cause the latch members 212 to pivot in a clockwise direction against the action of the springs 222. Upon the studs 228 moving past the lower edges of the recesses 220, the latch members 212 snap back into supporting positions in respect of the studs 228 so as to latch the depository container 24 securely and accurately in its correct operational position in the framework 10.

The base 129 of the bin 114 is removable and is normally held in position by means of latches 240 (FIG. 3) provided at the front and rear of the bin 114. When it is desired to remove envelopes from the depository container 24, for example when indicating means (to be described hereinafter) indicate that the container 24 is full, the latches 240 are released so as to enable the base 129 to be removed from the remainder of the bin 114. The stack of envelopes 122 can then be removed from the container 24 through the open bottom of the bin 114, having first removed the support member 130.

Figure 7:
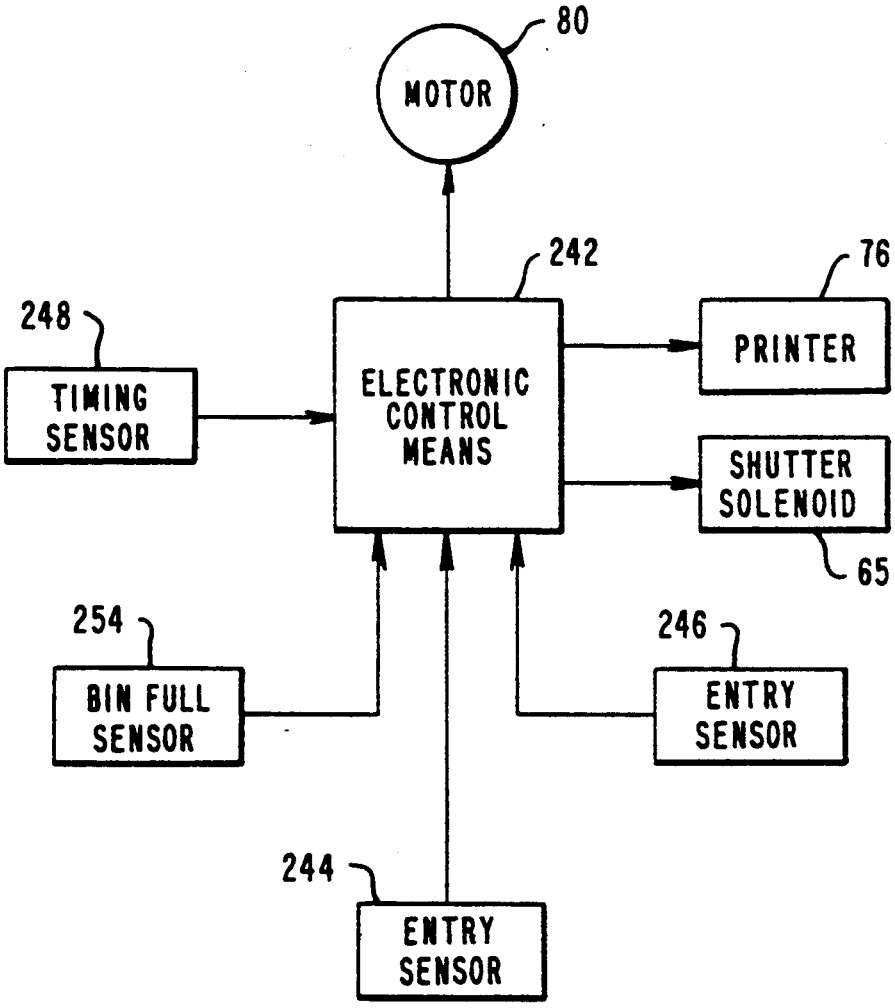
FIG. 7 is a schematic block diagram illustrating the electrical interconnections of parts of the depository apparatus.

The operation of the depository apparatus will now be described with additional reference to FIG. 7. Immediately prior to an envelope deposit operation being initiated, the motor 80 is in a deactivated condition, and crank arms 106 and link members 110 are in the positions shown in FIG. 2 with the pusher portion 116 in its uppermost position relative to the bin 114, and with a stack of envelopes 122 (if any) already inserted in a depository container 24 being held between the upper surface 128 of the support member 130 and the lower faces of the flaps 132.

An envelope deposit operation is initiated by a user inserting a customer identifying card into a card entry slot (not shown) in the user console 26 and entering appropriate data upon keyboard means (not shown) also included in the user console 26. As a result of this operation being initiated, the shutter actuating solenoid 65 is energized by electronic control means 242 included in the ATM so as to cause the shutter 64 to be retracted. Following the retraction of the shutter 64, the customer inserts the envelope 122' containing money through the entry slot 22 and into the entry throat of the belts 18 and 20 as previously described. The insertion of the leading edge of the envelope 122' into the entry throat of the belts 18 and 20 is sensed by optical sensor means 244 (FIGS. 1 and 7) which sends a signal to the electronic control means 242 for the purpose of causing the electronic control means 242 to activate the motor 80 in such a sense as to drive the drive shaft 78 in a clockwise direction and thereby cause the transport mechanism 16 to commence operation, with the belts 18 and 20 being driven in the direction of the associated arrows in FIG. 2. Upon the commencement of operation of the transport mechanism 16, the envelope 122' is gripped by the belts 18 and 20 and is driven by the belts 18 and 20 to the depository container 24 past the printer 76. In response to receipt of a further signal from the sensor means 244 when the sensor means 244 senses the trailing edge of the envelope 122', the electronic control means 242 de-energizes the shutter actuating solenoid 65, thereby causing the shutter 64 to return to its blocking position, and initiates the operation of the printer 76. The printer 76 is operated under the control of the control means 242 so as to print on the envelope 122' information such as identifying information in respect of the customer, and the amount of money contained in the envelope 122' as entered by the customer on the keyboard means.

During the final part of the movement of the envelope 122' by the transport mechanism 16, the envelope 122' passes through the aperture 235 over the guide member 232 of the bin 114 and is deposited by the transport mechanism 16 in the interior of the depository container 24, with the long edges of the envelope 122' being respectively supported on the flaps 132 as shown in FIG. 4, and with the leading edge of the envelope 122' located adjacent the rear wall 126 of the bin 114. As the envelope 122' is deposited in the container 24, the trailing edge of the envelope 122' is sensed by further optical sensor means 246 (FIGS. 1 and 7) located adjacent the front wall 124 of the bin 114, whereupon the sensor means 246 sends a signal to the control means 242 so as to cause the control means 242 to deactivate the motor 80 and then, immediately thereafter, to activate the motor 80 in the opposite sense.

Activation of the motor 80 in the opposite sense serves to drive the drive shaft 78 in a counterclockwise direction. As previously described, rotation of the drive shaft 78 in a counterclockwise direction causes the assembly of the shaft 92 and crank arms 106 to rotate in a counterclockwise direction, which in turn initially causes the pusher portion 116 incorporating the pusher block 146 to move downwards under the action of the rod 108 connected to the link members 110; at this time the transport mechanism 16 is in a deactivated condition. As the pusher block 146 moves downwards it engages the envelope 122' supported on the flaps 132, and continued downward movement of the pusher block 146, against the action of the torsion spring 190 and the springs 136, causes the flaps 132 to be pivoted downwards with the envelope 122' being moved past the flaps 132 and into juxtaposition with the top envelope of the stack of envelopes 122 already contained in the bin 114 beneath the flaps 132. When the pusher portion 116 reaches its lowermost position relative to the storage bin 114, the envelope 122', block 146 and flaps 132 are in the positions shown in FIG. 5. Continued rotation of the drive shaft 78 in a counterclockwise direction enables the pusher portion 116 and flaps 132 to return towards their home positions shown in FIG. 4 under the action of the torsion spring 190 and springs 136.

When the shaft 92 has completed exactly one revolution in a counterclockwise direction, then the electronic control means 242 causes the motor 80 to be deactivated, the pusher portion 116 and flaps 132 now being back in their home positions, and the newly deposited envelope 122' now being the uppermost envelope of the stack of envelopes contained in the bin 114. The stack of envelopes is held in position under the flaps 132 by virtue of being supported by the resiliently mounted support member 130. Referring to FIGS. 1 and 7, activation of the motor 80 is brought about by the electronic control means 242 under the control of timing signals from an optical sensor 248 operatively associated with a timing disc 250 (the sensor 248 and disc 250 not being shown in FIG. 2) secured on the drive shaft 78, the timing disc 250 carrying a series of equally spaced, radially extending marks, and the timing signals being generated in response to the sensing of successive marks by the sensor 248. Thus, the timing signals are generated in synchronism with the rotation of the shaft 78, and also in synchronism with the rotation of the shaft 92.

Further envelopes can be deposited in the depository container 24 in the manner just described, all the deposited envelopes being contained in an orderly stack in the bin 114. When the bin 114 is full, as indicated by the lower edge 252 of the support member 130 being sensed by optical sensing means 254 (FIG. 1 and 3) via apertures (not shown) in the walls 120 of the bin 114, a BIN FULL signal is sent by the sensing means 254 to the control means 242, this signal inhibiting further operation of the depository apparatus until after the depository container 24 has been removed from the apparatus for emptying, and the empty depository container 24, or a replacement depository container, has been placed in position in the apparatus.

In order to remove the stack of envelopes 122 from the bin 114, the base 129 is first removed from the remainder of the bin 114, and then, with the support member 130 still remaining within the bin 114, the torsion in the spring 190 is released by manual operation of the projection 203 so as to disengage the pawl 200 from the ratchet wheel 194. It should be understood that the damping collar 196 serves to slow down the rate of oscillation of the spring 190 after it uncoils, so as to prevent damage to the spring 190 or any part associated therewith when the pawl 200 is disengaged from the ratchet wheel 194. After the torsion in the spring 190 has been released, it is a simple matter to slide the stack of envelopes 122 out of the bin 114 together with the support member 130.

Following the removal of the stack of envelopes 122 from the bin 114, the support member 130 is replaced in the bin 114 by first engaging the rails 176 in the slots 178 and then manually pushing the support member 130 along the rack members 180 until the surface 128 of the support member 130 comes into engagement with the flaps 132; during this movement of the support member 130, the ratchet wheel 194 rotates together with the gear wheels 186, 188 in a counterclockwise direction with reference to FIG. 5 so that no torsion builds up in the spring 190. When the support member 130 has come into engagement with the flaps 132, the support member 130 is released and, thereafter, it is held in position adjacent the flaps 132 by virtue of the spring 190 resisting the tendency of the support member 130 to move under gravity away from the flaps 132. The base 129 is then reattached to the bin 114 and the empty depository container 24 is now in a condition for reinsertion in the depository apparatus.

Figure 8:
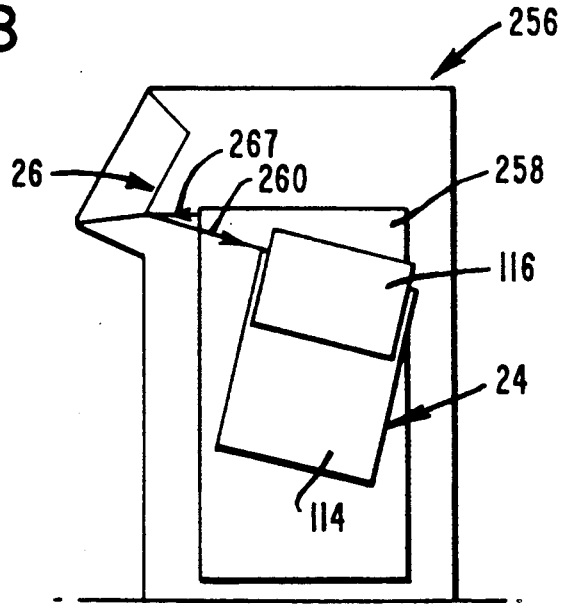
FIG. 8 is a schematic side elevational view of an in-lobby ATM incorporating the depository apparatus of the present invention mounted in a side-by-side relationship with respect to a cash dispenser mechanism.

Referring now to FIG. 8, the depository apparatus described above can be incorporated in an in-lobby ATM 256 in which the depository container 24 is mounted in a side-by-side relationship with respect to a cash dispenser mechanism 258, and in which the depository container 24 is in a position such that the support member 130 is beneath the flaps 132 (so that the pawl 200 is held by gravity in engagement with the ratchet wheel 194). In operation of the ATM 256, envelopes are fed to the depository container 24 from an entry aperture (not shown in FIG. 8) in the user console 26 along a feed path 260, and currency notes are fed from the cash dispenser mechanism 258 to an exit aperture (not shown) in the user console 26 along a feed path 262. In this arrangement, the entry and exit apertures for the envelopes and currency notes are each at a height of about 1.05 meters above the ground which is an acceptable height for such apertures in an in-lobby ATM. It should be understood that the ATM 256 can be designed so that the depository container 24 is removable from the front of the ATM 256, or can be designed so that the container 24 is removable from the rear of the ATM 256.

Alternatively, the depository apparatus can be incorporated in an ATM 264 mounted through the wall 266 of a bank or other building, with the depository container 24 being mounted above a cash dispenser mechanism 268. In operation of the ATM 264, envelopes are fed to the depository container 24 from an entry aperture (not shown) in the user console 270 of the ATM 264 along a feed path 272, and currency notes are fed from the cash dispenser mechanism 268 to an exit aperture (not shown) in the user console 270 along a feed path 274. In regard to the through-the-wall ATM 264, since the depository container 24 is mounted above the cash dispenser mechanism 268, the ATM 264 covers a smaller floor area than the in-lobby ATM 256, but has a greater height than the ATM 256. In the ATM 264, the depository container 24 is in an inverted position compared with its position shown in FIGS. 3 to 5. Thus, the support member 130 is positioned above the flaps 132 with the edge 252 of the support member 130 uppermost, so that the stop portion 276 (FIG. 5) of the pawl 200 is held by gravity out of engagement with the ratchet wheel 194. As a result, torsion is not built up in the torsion spring 190 as the support member 130 is moved upwardly away from the flaps 132 during the stacking of envelopes in the storage bin 114. It will be appreciated that, with the depository container 24 in this inverted position, the torsion spring 190 has no effect and it is simply the weight of the support member 130 and the parts mounted thereon which urges the stack of envelopes in the bin 114 against the flaps 132.

The depository container 24 described above has the advantage that a stack of envelopes in the storage bin 114 can be readily removed from the bin 114 by removing the base 129, releasing, if necessary, the torsion in the spring 190, and removing the stack of envelopes, together with the support member 130, from the end of the bin 114 remote from the flaps 132. Thus, the container 24 enables the stack to be removed without disturbing the order in which the envelopes were stacked in the container 24, which assists checking and reconciliation procedures after the stack has been removed.

Figure 9:
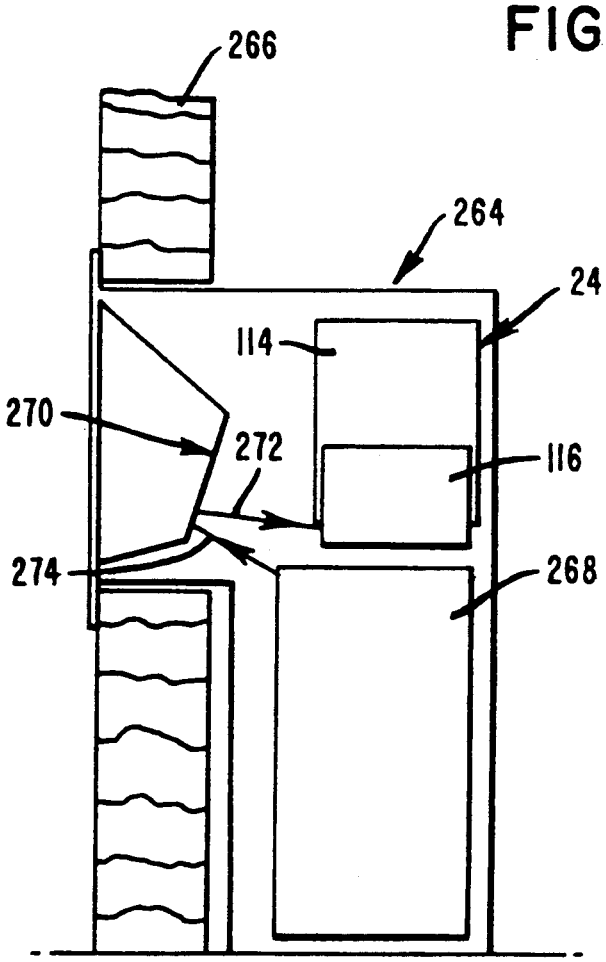
FIG. 9 is a schematic side elevational view of a through-the-wall ATM incorporating the depository apparatus of the present invention mounted above a cash dispenser mechanism.

Another advantage of depository container 24 described above is that the container 24 is versatile in that it may be used either in a position as shown in FIGS. 3 to 5 and FIG. 8, in which the support member 130 is disposed beneath the flaps 132, or in a position as shown in FIG. 9, in which the container 24 is inverted so that the support member 130 is disposed above the flaps 132. No modification of the container 24 is necessary when its use is changed from being in one operational position to being in an inverted operational position.

What is claimed is:

1. A container for holding a stack of articles, said container including an aperture for receiving articles one by one to be stacked in said container, a receiving portion for receiving the articles passed through said aperture and a storage portion for storing articles which have been received in said container, comprising:

gate means in said container for permitting, during a stacking operation, one-way passage of an article from said receiving portion of said container into said storage portion of said container;

pusher means movable between first and second positions and arranged when moved from said first position to said second position to push an article in said receiving portion past said gate means and into said storage portion; and resilient support means mounted in said storage portion and arranged to support a stack of articles, said support means including a support member slidably mounted in said storage portion so as to be movable toward and away from said gate means, a shaft rotatably mounted on said support member, first and second gear means respectively secured to opposite end portions of said shaft, first and second rack members fixed relative to said storage portion and respectively engageable with said first and second gear means whereby movement of said support member towards or away from said gate means brings about rotation of said shaft in a direction determined by the direction of movement of said support member, a torsion spring mounted on said shaft with said shaft passing through said spring so as to be substantially coaxial therewith having one end of said spring secured to said shaft, retaining means rotatably mounted on said shaft and having said other end of said spring secured to said retaining means, and engagement means mounted on said support member and arranged to be engageable with said retaining means whereby, when said engagement means is in engagement with said retaining means and said support member is moved away from said gate means in response to movement of said pusher means toward said second position, rotation of said retaining means in the same direction as said shaft is prevented, thereby causing torsion to be built up in said spring, said torsion serving to urge said support member back toward said gate means when said pusher means moves back toward said first position.

2. The container of claim 1, also including door means via which said support member and said stack may be removed from said container.

3. The container of claim 2, in which said door means is located in a part of the storage portion which is remote from said gate means.

4. The container of claim 1, in which said retaining means comprises ratchet means, and in which said engagement means comprises pawl means pivotally mounted on said support member.

5. The container of claim 4, in which, when said container is positioned with said support member beneath said gate means, said pawl means is held by gravity in engagement with said ratchet means and when said container is positioned with said support member above said gate means, said pawl means is held by gravity out of engagement with said ratchet means.

6. The container of claim 2, also including manually operable means for disengaging said engagement means from said retaining means to release torsion in said spring while said support member is mounted in said storage portion.

7. The container of claim 6, in which said manually operable means is accessible via said door means while said support member is mounted in said storage portion.

8. The container of claim 6, in which said engagement means comprises pawl means, and in which said manually operable means comprises a projection on said pawl means.

9. The container of claim 1, also including a damping collar of elastomeric material secured to said shaft, and in which said one end of said spring is secured to said damping collar.

10. The container of claim 1, in which said container comprises a storage bin adapted to hold a stack of articles and also comprises a pusher portion including said pusher means, said pusher portion being resiliently attached to said storage bin.

11. A container for holding a stack of articles, said container including an aperture for receiving articles one by one to be stacked in said container, a receiving portion for receiving the articles passed through said aperture and a storage portion for storing articles which have been received in said container, comprising:

gate means in said container for permitting, during a stacking operation, one-way passage of an article from said receiving portion of said container into said storage portion of said container;

pusher means movable between first and second positions and arranged when moved from said first position to said second position to push an article in said receiving portion past said gate means and into said storage portion; and resilient support means mounted in said storage portion and arranged to support a stack of articles, said support means including a support member slidably mounted in said storage portion so as to be movable toward and away from said gate means, shaft means rotatably mounted on said support member, gear means secured to said shaft means, rack means fixed relative to said storage portion and engageable with said gear means, spring means coupled to said shaft means, retaining means rotatably mounted with respect to said shaft means and coupled to said spring means, and engagement means mounted on said support member and engageable with said retaining means, whereby when said engagement means is engaged with said retaining means and said support member is moved away from said gate means, tension is built up in said spring means to urge said support member back toward said gate means when said pusher means moves back toward said first position.

* * * * *